US005445582A

United States Patent [19]

Brown

[11] Patent Number: 5,445,582

[45] Date of Patent: Aug. 29, 1995

[54] HAND EXERCISER DEVICE

[76] Inventor: Gary L. Brown, 7607 Mosewood, Houston, Tex. 77040

[21] Appl. No.: 177,254

[22] Filed: Jan. 1, 1994

[51] Int. Cl.[6] ..... A63B 23/16; A63B 21/02

[52] U.S. Cl. ..... 482/48; 482/44; 482/47; 482/49; 482/91; 482/124; 601/40

[58] Field of Search ..... 482/47, 44, 48, 49, 482/50, 91, 148, 907, 124; 601/23, 40; 602/21, 22; 128/878, 879, 880; 84/465; 2/170; D21/198

[56] References Cited

U.S. PATENT DOCUMENTS

| | | | |
|---|---|---|---|
| 4,724,827 | 2/1988 | Schenck | 601/40 |
| 4,815,729 | 3/1989 | Stefanski | 482/48 |
| 4,873,968 | 10/1989 | Finnieston et al. | 602/21 |

FOREIGN PATENT DOCUMENTS

| | | | |
|---|---|---|---|
| 0848319 | 8/1970 | Canada | 482/48 |
| 1260271 | 3/1961 | France | 482/44 |
| 0293622 | 5/1917 | Germany | 602/22 |
| 2424449 | 12/1975 | Germany | 482/47 |
| 0566149 | 9/1975 | Switzerland | 482/48 |

OTHER PUBLICATIONS

Zimmer, Fracture Appliances, Banjo Splint, Aug. 1947, 1 page.

Asian World of Martial Arts, Inc. Advertisement, Black Belt Magazine, Jul. 1986, 1 page.

*Primary Examiner*—Richard J. Apley
*Assistant Examiner*—Victor K. Hwang

[57] ABSTRACT

An exerciser device having a band, a wrist securing member connected to the band such that the band extends outwardly of the wrist securing member, and finger engagement member affixed to the band at a position generally opposed to the wrist securing member. The wrist securing member serves for removable attachment around a human wrist. The finger engagement member extends inwardly of the band. A thumb engagement member is affixed to the band at a position generally between the finger engagement member and the wrist securing member. The band has a generally rigid and generally circular configuration extending from the wrist securing member. The finger engagement member includes a slide member extending around an exterior of the band and a plurality of finger receptacles extending from the slide member in a direction generally facing the wrist securing member. The thumb engagement member includes a first thumb receptacle, a second thumb receptacle, and a member connected to and extending between the first and second thumb receptacles.

15 Claims, 3 Drawing Sheets

HAND EXERCISER DEVICE

TECHNICAL FIELD

The present invention relates to exercising devices. More particularly, the present invention relates to devices for exercising the hand and wrist.

BACKGROUND ART

Exercisers are often required for the fingers to strengthen the fingers, the hand, the wrist, and the forearm, or for therapeutic reasons when the fingers or portions of the hand have been injured. The muscles pertaining to the fingers accomplish flexing of the fingers and bending thereof and extend along the finger and hand and into the forearm. It is, at times, desirable to exercise these muscles, as well as to flex the finger and knuckle joints for reasons of therapy or development. Proper exercise of such muscles and joints should be balanced to provide for proper results while, at the same time, individual exercise of one or more fingers or joints may be needed.

In the past, various U.S. patents have issued for devices that are intended for the exercise of the human hand. For example, U.S. Pat. No. 5,062,625, issued on Nov. 5, 1991, to J. C. M. Vonk provides a hand exerciser made of a resilient material and having a number of finger engaging ports, each connected to one side of a body portion by bridging segments. The body portion to the side opposite the finger engaging ports includes a thumb engaging port. The exercise device is made of one piece rubber material.

U.S. Pat. No. DE 325,611, issued on Apr. 21, 1992, to Lewis et al. shows a hand exerciser in which an outer band includes a plurality of spring-connected finger receptacles. The finger receptacles are positioned interior of the outer band.

U.S. Pat. No. 4,961,568, issued on Oct. 9, 1990, to Clark et al. provides an exercise device for the fingers which permits the index and middle fingers of the hand to be spread apart in a manner so as to stress the finger joints. The distance between the index and middle fingers can be set and extended, as required.

U.S. Pat. No. 5,078,388, issued on Jan. 7, 1992, to L. Dempsey, Jr. provides a hand grip exerciser that has a frame with spaced, parallel side rails, and an end cross rail connecting the first ends of the side rail and a second cross rail parallel to the end cross rail and connecting the side rails at points spaced from the ends thereof. A number of elastic cord lengths connect and extend between the side rails in spaced parallel relationship to one another and between the two cross rails.

U.S. Pat. No. 2,634,976, issued on Apr. 14, 1953, to J. E. Mock provides an adjustable grip developer in which a plurality of finger receptacles are spring-mounted within a housing. Exercise is provided by compressing the springs within the housing.

U.S. Pat. No. 3,782,719, issued on Jan. 1, 1974, to N. J. Kuhlman shows an exercising device having a base member on which the forearm is adapted to rest with the hand in a predetermined position. Finger loops are carried by the device so as to be disposed near this portion and adapted to receive fingers of the hand. Biasing springs are connected to the finger loops so as to resist movement of the fingers.

U.S. Pat. No. 4,730,827, issued on Mar. 15, 1988, to G. R. Williams provides a hand rehabilitation device including a circular planar disk having a series of spread-apart recesses in its circumference so as to receive the fingers of a patient's hand. The thumb is inserted through a selected one of a plurality of openings.

U.S. Pat. No. 4,765,608, issued on Aug. 23, 1988, to J. C. Bonasera provides an exercising device for the wrist and fingers of a musician. A fork is secured to the wrist of the user and tines of the fork are provided with sleeves having resilient components attached for applying tension to the fingers. Hook-and-loop fastener straps are provided so as to secure the components to the fingers of the musician.

U.S. Pat. No. 4,828,249, issued on May 9, 1989, to M. D. Keating shows an exercising device comprising an elastomeric polygonal body member having a plurality of holes such that it can be squeezed and compressed in the hand or stretched with the thumb and fingers in the holes.

It is an object of the present invention to provide an exercise device for the exercising of the fingers, hand, and forearm.

It is another object of the present invention to provide an exercise device that assists in the rehabilitation from hand surgeries, strains, broken bones, or torn muscles.

It is a further object of the present invention to provide an exercise device that is relatively easy to use, generally inexpensive, and easy to manufacture.

These and other objects and advantages of the present invention will become apparent from a reading of the attached specification and appended claims.

SUMMARY OF THE INVENTION

The present invention is an exerciser device that includes a band, a wrist securing means connected to the band such that the band extends outwardly of the wrist securing means, and finger engagement members affixed to the band at a position generally opposed to the wrist securing means. The wrist securing means serves for removable attachment around a human wrist. The finger engagement members extend inwardly of the band toward the wrist securing means. A thumb engagement member may be affixed to the band at a position between the finger engagement members and the wrist securing means.

The band has a generally rigid and circular configuration extending from the wrist securing means. The band can be made of an elastomeric or plastic material. The band is resistive of deformation by forces applied to the finger engagement members.

The wrist securing means includes a first wrist receptacle portion, a second wrist receptacle portion connected to the first wrist receptacle portion, and a fastener attached to the first and second wrist receptacle portions for adjustably securing the receptacle portions to the human wrist. The first and second wrist receptacle portions define an area for adjustably extending around the human wrist. The fastener includes a strap having a portion affixed to the first wrist receptacle portion and another portion affixed to the second wrist receptacle portion. A buckle is affixed to an end of the strap so as to detachably receive an opposite end of the strap. The strap includes a section of hook-and-loop material affixed to a surface thereof adjacent one end. The strap includes a complementary section of hook-and-loop material affixed adjacent to the opposite end. Each of the wrist receptacle portions includes an outer body of generally rigid material, and an inner foam surface affixed to an interior of the outer body. The foam surface is for contact with the human wrist. The band is affixed to the outer body of the first wrist receptacle portion and extends outwardly therefrom.

The finger engagement members include a slide member extending around an exterior of the band, and a plurality of finger receptacles extending from the slide member in a direction generally facing the wrist receptacle means. The slide member has an interior slide area for receiving the band. The finger receptacles are affixed to the body and extend outwardly therefrom. The body is received within the slide area of the slide member. The body is in generally surface-to-surface contact with a surface of the band in the slide area. The body is interposed between the slide member and the band. The slide member has a plurality of openings formed on a surface facing the wrist securing means. The finger receptacles extend through these openings. Each of the finger receptacles includes a finger receiving loop, and an arm extending outwardly and rearwardly of the loop. The arm is connected to the slide member. The finger engagement members are formed of an elastomeric material generally resistive of finger forces imparted to the finger engagement members.

The thumb engagement member includes a slide body extending around an exterior of the band, and a thumb receptacle extending from the slide body in a direction generally transverse to the finger engagement members. The thumb receptacle can include a first thumb receptacle, a second thumb receptacle, and a member connected to and extending between the first and second thumb receptacles. The first and second thumb receptacles are angularly offset from each other. .Each of the thumb receptacles has a central axis transverse to a central axis of the band. The thumb receptacle is formed of an elastomeric material generally resistive of the forces imparted by a human thumb.

DETAILED DESCRIPTION OF THE INVENTION

Figure 1:
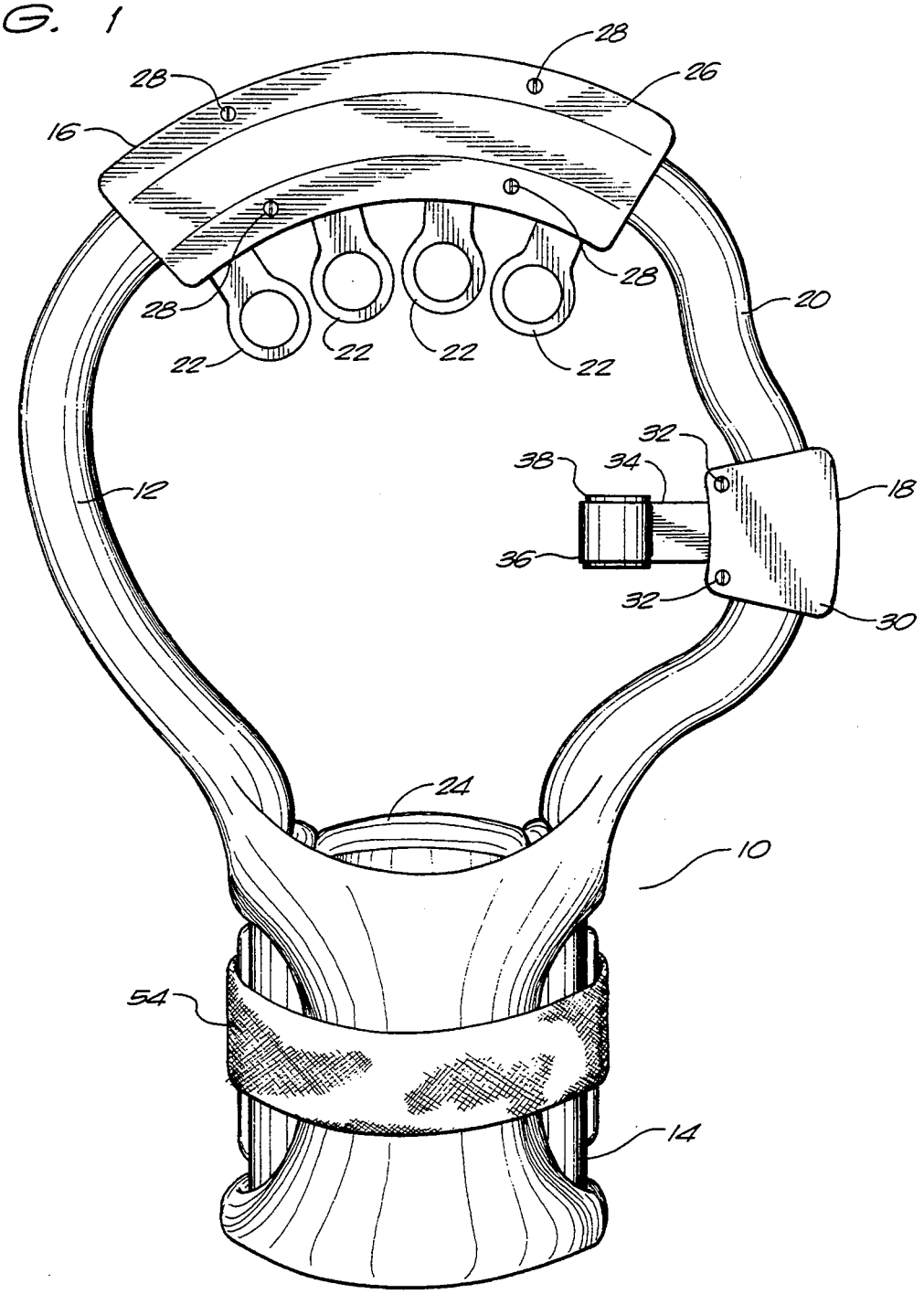
FIG. 1 is a plan view showing the exercise device in accordance with the preferred embodiment of the present invention.

Referring to FIG. 1, there is shown at 10 the exercise device in accordance with the preferred embodiment of the present invention. The exercise device 10 includes a band 12, a wrist securing member 14, a finger engagement member 16, and a thumb engagement member 18. The wrist securing member 14 is connected to the band 12 such that the band extends outwardly of the wrist :securing member 14. The wrist securing member 14 is for removable attachment around a human wrist. The finger engagement member 16 is affixed to the band 12 at a position generally opposed to the wrist securing member 14. The finger engagement member 16 extends generally inwardly of the band 12. The thumb engagement member 18 is affixed to the band 12 at a position between the finger engagement member 16 and the wrist securing member 14.

In FIG. 1, it can be seen that the band 12 has a generally circular configuration extending from the wrist securing member 14. The circular configuration of the band 12 is adapted so as to conform to the outer profile of the human hand. It can be seen that the generally circular configuration is interrupted on one side by the outwardly bulging area 20. The outwardly bulging area 20 is designed so as to properly accommodate the area of the thumb. The band 12 can be made of a plastic or elastomeric material. In general, the band 12 is of a rigid configuration which is resistive of deformation. When fingers are placed into the finger receptacles 22 of the finger engagement member 16, the band 12 should have a sufficient strength so as to resist easy deformation of the band by forces imparted to the finger receptacles 22. Similarly, the band 12 should have sufficient strength so as to resist deformation caused by forces applied to the thumb engagement member 18 at the area of the bulging area 20.

In FIG. 1, it can be seen that the wrist securing member 14 has an interior opening 24 that allows for the wrist to extend outwardly of the wrist securing member 14. A strap 54 extends around the back of the wrist securing member 14. As will be described in conjunction with FIG. 2, the strap 54 is an adjustable band that allows for the wrist securing member 14 to be detachably received around the human wrist.

In FIG. 1, it can be seen that the finger engagement member 16 has a slide member 26 extending around an exterior of the band 12. A plurality of finger receptacles 222 extend from the slide member 26 in a direction generally facing the wrist securing member 14. As will be described hereinafter, the slide member 26 has an interior slide area for receiving the band 12. The slide member 26 of the finger engagement member 16 is secured to band 12 through the use of screws 28.

The thumb engagement member 18 also includes a slide body 30 that extends around an exterior of the band 12 at the bulging area 20. The slide body 30 is fixedly secured to the exterior of the band 12 through the use of screws 32. The thumb receptacle 34 extends from the slide body 30 in a direction generally transverse to the finger engagement members 22. As will be described hereinafter, the thumb receptacle 34 includes a first thumb receptacle 36 and a second thumb receptacle 38. A member is received within the slide body 30 which extends between the first thumb receptacle 36 and the second thumb receptacle 38. The first thumb receptacle 36 is angularly offset from the second thumb receptacle 38. Each of the thumb receptacles 36 and 38 has a central axis which is transverse to the central axis of the band 12. The thumb engagement member 18 is formed of an elastomeric material generally resistive of forces imparted by a human thumb received within the thumb receptacles 36 and 38.

In normal use, the user of the exercise device 10 will place the wrist securing member 14 around his or her wrist. The fingers will extend outwardly through the opening 24 so as to be in an area adjacent to the finger receptacles 22. The user will insert his or her fingers into the finger receptacles 22 of the finger engagement member 16. Additionally, the user will place his or her thumb into the appropriate thumb receptacle 36 or 38. In this arrangement, forces can be placed on the finger engagement member 16 and the thumb engagement member 18 so as to exercise the muscles, joints, and forearm of the user. The resistance of the band 12 will create the necessary resistive forces so as to properly strengthen the hand of the user.

Figure 2:
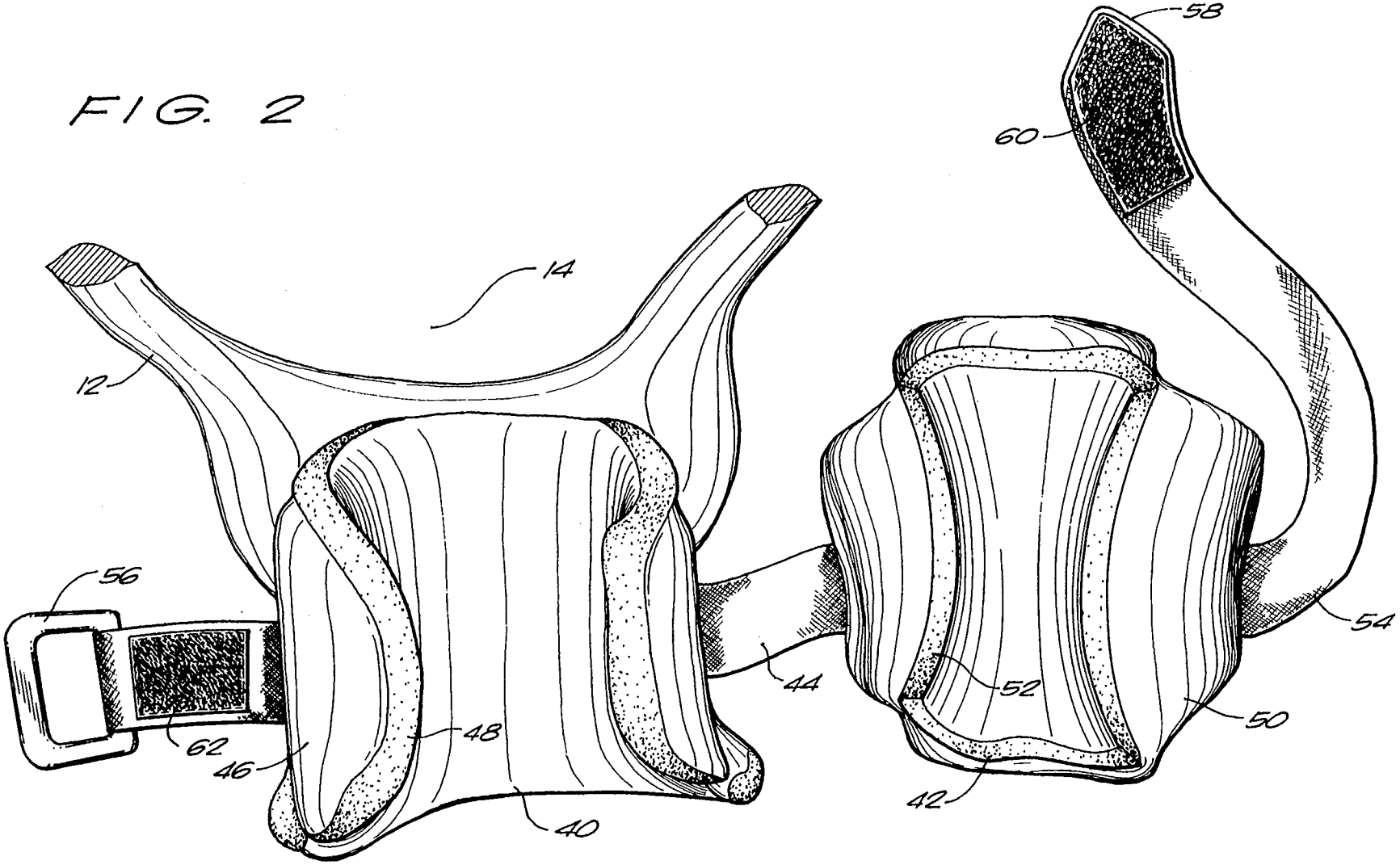
FIG. 2 is an open generally exploded view of the wrist securing means of the present invention.

FIG. 2 is an isolated view of the wrist securing member 14. As can be seen, the wrist securing member includes a first wrist receptacle portion 40, a second wrist receptacle portion 42, and a fastener 44. It can be seen that the first wrist receptacle portion 40 has an outer body 46 made of a generally rigid material. The outer body 46 of the first wrist receptacle 40 is made of an elastomeric or a plastic material. The shape of the outer body 46 generally conforms to the shape of a human wrist. The band 12 is affixed to (or formed integrally with) the outer body 46 of the first wrist receptacle 40. The band 12 extends outwardly from the first wrist receptacle 40. An inner foam surface 48 is positioned within the outer body 46 in the first wrist receptacle 40. The foam extends around the inner surface of the outer body 46 so as to be juxtaposed against the human wrist when the wrist receptacle 40 is affixed thereto. The foam material 48 serves to cushion the wrist during the application of forces to the exercise device. The second wrist receptacle 42 is connected by fastener 44 to the first wrist receptacle 40. As can be seen, the second wrist receptacle 42 has an outer body 50 of a generally rigid material and an inner foam surface 52. The first wrist receptacle 40 and the second wrist receptacle 42 define an interior area for adjustably extending around the human wrist. In normal use, the wrist will be placed into the interior of the first wrist receptacle 40 and then the second wrist receptacle 42 will be placed over the remaining portion of the wrist.

The fastener 44 is a single strap 54 having a portion affixed to the first wrist receptacle 40 and another portion affixed to the second wrist receptacle 42. The strap 54 can be attached to the wrist receptacles 40 and 42 in various ways, such as adhesively bonding, extending the strap through loops on the receptacles, or integrally forming them together. A buckle 56 is provided at an end of the strap 54. The buckle 56 serves to detachably receive the opposite end 58 of the strap 54. As can be seen, the strap 54 has a section 60 of hook-and-loop material affixed to a surface of the strap 54. The strap 54 also includes a complementary section 62 of hook-and-loop material affixed adjacent to the buckle 56 at the opposite end of the strap 54. When the wrist receptacles 40 and 42 are placed over the human wrist, the end 58 of the strap 54 is inserted into buckle 56, wrapped therearound such that the hook-and-loop material 60 engages the complementary section 62. In this fashion, the wrist securing member 14 is properly positioned on the human wrist.

Figure 3:
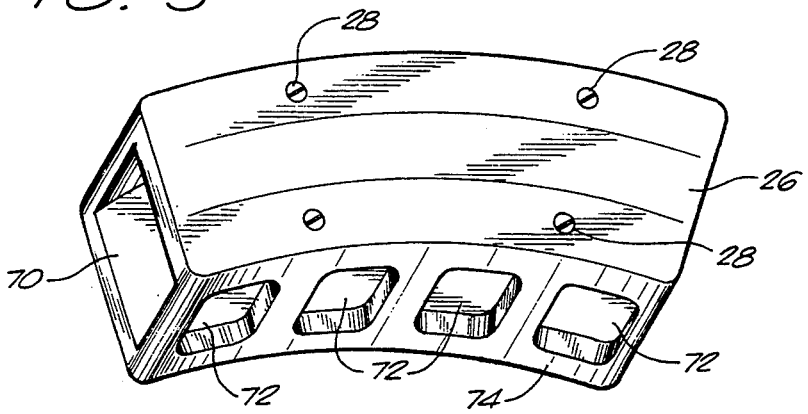
FIG. 3 is an isolated perspective view of the slide member for the finger engagement members.

FIG. 3 shows the slide body 26 of the finger engagement member 16. The slide body 26 has a generally curved configuration with a slide area 70 formed therein. The interior slide area 70 will receive the exterior of the band 12. The slide member 26 includes a plurality of openings 72 formed on the surface, 74 of the slide body 26. The openings 72 extend to and communicate with the slide area 70. The finger receptacles 22 will extend through the opening 72. The slide body 26 can be formed in half sections such that the half section can be secured together through the use of screws 28 and such that the slide body 26 can be properly secured to the band 12.

Figure 4:
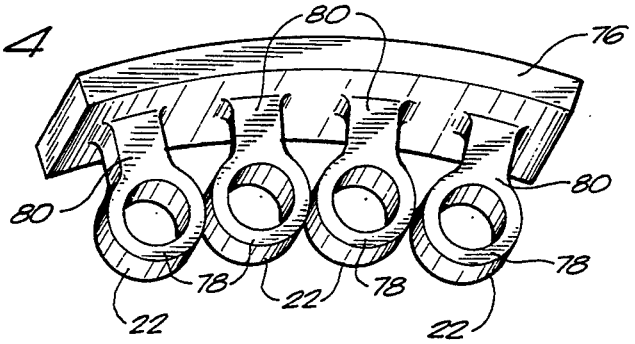
FIG. 4 is a perspective view of the finger receptacles as used in the present invention.

FIG. 4 shows the finger receptacles 22. The finger receptacles 22 are affixed to a body 76 having a curvature generally conforming to the interior curvature of the band 12 and conforming to the slide area 70 of the slide body 26. The finger receptacles 22 extend outwardly from the body 76. The body 76 is received within the slide area 70 of the slide body 26. The body 76 is in generally surface-to-surface contact with a surface of the band 12 and with an interior surface of the slide body 26. The body 76 will be interposed between the slide member 26 and the band 12. The finger receptacles 22 will extend outwardly through the opening 72 in the slide body 26.

Each of the finger receptacles 22 includes a finger receiving loop 78 and an arm 80. The arm 80 extends outwardly and rearwardly from the loops 78. The arm is connected to the body 76 and will extend through the opening 72 of the slide body 26. The arrangement of the finger receptacles 22 will generally conform to the anticipated position of the fingers.

Figure 5:
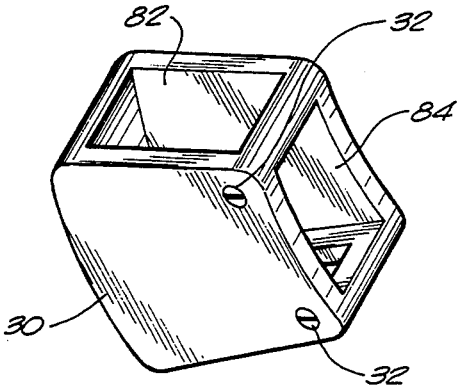
FIG. 5 is a perspective view of the slide body for the thumb receptacle of the present invention.

FIG. 5 shows the slide body 30 of the thumb engagement member 18. It can be seen that the slide body 30 includes an interior slide area 82 which will extend around the exterior of the band 12. An opening 84 is provided so as to allow the thumb receptacles to extend outwardly therefrom. Screws 32 are provided so as to properly secure the slide body 30 to the band 12 and to affix the thumb receptacles within the interior of the slide body 30.

Figure 6:
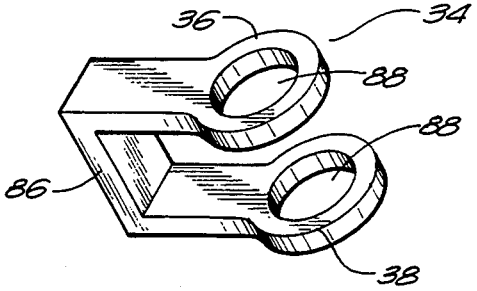
FIG. 6 is a perspective view of the thumb receptacle of the present invention.

FIG. 6 shows the isolated view of the thumb receptacle 34. It can be seen that the thumb receptacle 34 includes a first thumb receptacle 36 and a second thumb receptacle 38. A member 86 is connected to and extends between the first thumb receptacle 36 and the second thumb receptacle 38. As can be seen, the first thumb receptacle 36 is angularly offset from the second thumb receptacle 38. Each of the thumb receptacles 36 and 38 has a central axis through the opening 88 which is transverse to the central axis of the band 12. The openings 88 receive the thumbs of the user for the purpose of exercise. The use of the first thumb receptacle 36 and the second thumb receptacle 38 accommodates left hand or right hand use of the exercise device 10. It also allows for the exercise device 10 to be positioned upwardly or downwardly relative to the hand of the user.

The present invention is an exercise and rehabilitation device. This device 10 exercises the fingers, the tendons, the muscles of the hand, the muscles of the forearm, and also all of those muscles that control hand and finger movement. The device 10 is excellent for rehabilitation of hand surgeries, strains, broken bones, or torn muscles of the hand and wrist. It also helps to relieve soreness and arthritis in the hand and wrist. Football players, baseball players, basketball players, golfers, bowlers, boxers, and others can receive the benefits of the present exercise device. Persons with arthritic hands can also properly exercise through the use of the device.

The sliding configuration for the finger engagement members and the thumb engagement member allows it to be adjustable for various sizes of hands. The use of the wrist securing member 14 allows the device to be adjustable for small or large wrists. It can be used on both hands merely by flipping it over and by reattaching the device 10. The present device has a space age design. It can be made of multiple colors. It is easy to use, easy to carry, light weight, and has a very unique and attractive design. The device can be used in warm and cold temperatures for different results.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

I claim:

1. An exerciser device comprising:

a band;

a wrist securing means connected to said band such that said band extends outwardly of said wrist securing means, said wrist securing means being adapted for removable attachment around a human wrist; and a finger engagement member affixed to said band at a position generally opposed to said wrist securing means, said finger engagement member extending inwardly of said band, said finger engagement member comprising:

a slide member extending around an exterior of said band; and a plurality of finger receptacles extending from said slide member in a direction generally facing said wrist securing means, said slide member having an interior slide area for receiving said band, said finger receptacles attached to an elongated body member and extending outwardly therefrom, said body member received within said slide area of said slide member.

2. The device of claim 1, said band having a generally rigid configuration, said band having a generally circular configuration extending from said wrist securing means.

3. The device of claim 2, said band being of a plastic material.

4. The device of claim 1, said band being of an elastomeric material.

5. The device of claim 1, said band formed in a generally circular configuration extending from said wrist securing means.

6. The device of claim 1, said wrist securing means comprising:

a first wrist receptacle portion;

a second wrist receptacle portion connected to said first wrist receptacle portion, said first and second wrist receptacle portions defining an area for adjustably extending around the human wrist; and fastener means attached to said first and second wrist receptacle portions, said fastener means for securing said first and second wrist receptacle portions to the human wrist.

7. The device of claim 6, said fastener means comprising:

a strap having a portion affixed to said first wrist receptacle portion and another portion affixed to said second wrist receptacle portion; and a buckle means affixed to an end of said strap, said buckle means for detachably receiving an opposite end of said strap.

8. The device of claim 6, each of said first and second wrist receptacle portions comprising:

an outer body of a generally rigid material; and an inner foam surface affixed to an interior of said outer body, said foam surface for contact with the human wrist.

9. The device of claim 8, said band affixed to said outer body of said first wrist receptacle portion and extending outwardly therefrom.

10. The device of claim 1, said elongated body member being in generally surface-to-surface contact with a surface of said band in said slide area, said elongated body member interposed between said slide member and said band.

11. The device of claim 1, said slide member having a plurality of openings formed on a surface facing said wrist securing means, said finger receptacles extending through said openings.

12. The device of claim 1, each of said finger receptacles comprising:

a finger receiving loop; and an arm extending outwardly and rearwardly of said loop, said arm connected to said slide member.

13. The device of claim 1, said engagement member formed of an elastomeric material generally resistive of finger forces imparted to said finger engagement member.

14. An exerciser device comprising:

a band;

a wrist securing means connected to said band such that said band extends outwardly of said wrist securing means, said wrist securing means being adapted for removable attachment around a human wrist;

a finger engagement member affixed to said band at a position generally opposed to said wrist securing means, said finger engagement member extending inwardly of said band; and a thumb engagement member affixed to said band at a position between said finger engagement member and said wrist securing means, said thumb engagement member comprising:

a slide body extending around an exterior of said band; and a thumb receptacle extending from said slide body in a direction generally transverse to said finger engagement member, said thumb receptacle comprising:

a first thumb receptacle;

a second thumb receptacle; and a member connected to and extending between said first and second thumb receptacles, said first and second thumb receptacles angularly offset from each other, each of said thumb receptacles having a central axis generally transverse to a central axis of said band.

15. The device of claim 14, said thumb receptacle being formed of an elastomeric material generally resistive of forces imparted by a human thumb.

* * * * *